US008241327B1

(12) United States Patent
Moore

(10) Patent No.: US 8,241,327 B1
(45) Date of Patent: Aug. 14, 2012

(54) PACIFIER CLEANLINESS INDICATOR

(76) Inventor: Maureen Moore, Manasquan, NJ (US)

( * ) Notice: Subject to any disclaimer, the term of this patent is extended or adjusted under 35 U.S.C. 154(b) by 885 days.

(21) Appl. No.: 12/317,518

(22) Filed: Dec. 24, 2008

Related U.S. Application Data

(60) Provisional application No. 61/008,848, filed on Dec. 26, 2007.

(51) Int. Cl.
*A61J 17/00* (2006.01)

(52) U.S. Cl. ..... 606/234

(58) Field of Classification Search ..... 606/234–236; 40/5, 310, 317, 324, 491; D9/550, 563; D24/193–199
See application file for complete search history.

(56) References Cited

U.S. PATENT DOCUMENTS

| | | | | |
|---|---|---|---|---|
| 2,013,616 | A * | 9/1935 | Rettenmeyer | 220/568 |
| 2,201,205 | A * | 5/1940 | Samburg | 215/230 |
| 4,405,045 | A * | 9/1983 | Villa-Real | 206/534 |
| 4,860,684 | A * | 8/1989 | Al-Harbi | 116/308 |
| 4,951,596 | A * | 8/1990 | Wallace, Jr. | 116/321 |
| D380,836 | S | 7/1997 | Fitzpatrick et al. | |
| D393,074 | S | 3/1998 | Fields et al. | |
| D413,387 | S | 8/1999 | Fitzpatrick et al. | |
| D453,379 | S | 2/2002 | Roehrig | |
| 6,695,869 | B2 | 2/2004 | Fitzpatrick et al. | |
| 6,742,953 | B2 * | 6/2004 | Burden et al. | 401/194 |
| 6,905,507 | B2 | 6/2005 | Hinshaw | |
| D520,640 | S | 5/2006 | Pils et al. | |
| D532,522 | S | 11/2006 | Struckmeier | |
| 7,516,746 | B1 * | 4/2009 | Davis | 134/113 |
| 2006/0162199 | A1 * | 7/2006 | Kang et al. | 40/446 |
| 2007/0260280 | A1 * | 11/2007 | Dunn et al. | 606/234 |

* cited by examiner

*Primary Examiner* — Katherine Dowe
(74) *Attorney, Agent, or Firm* — Montgomery Patent & Design, LLC; Robert C. Montgomery; Joseph Yaksich

(57) ABSTRACT

An integral display for a child's pacifier indicates whether it is clean and safe for the child's use. The pacifier has a selectable dial on its exterior rear face that allows the care-giver to select between "CLEAN" or "DIRTY", depending on the status of the pacifier. Once the pacifier is properly cleaned, the care-giver would slide the indicator to display "CLEAN". In such a manner, the care-giver would always be aware of the cleanliness of the pacifier and whether it would be safe to give to the child.

12 Claims, 3 Drawing Sheets

PACIFIER CLEANLINESS INDICATOR

RELATED APPLICATIONS

The present invention was first described in U.S. Provisional Patent Application No. 61/008,848 filed on Dec. 26, 2007, the entire disclosures of which are incorporated herein by reference.

FIELD OF THE INVENTION

The present invention relates generally to cleanliness indicator for pacifiers comprising a pacifier body with a mouth guard and a nipple attached thereto and a sliding member rotatably positioned between a first notifying inscription and a second notifying inscription viewable therethough a viewing port thereof the pacifier body to indicate a cleanliness state.

BACKGROUND OF THE INVENTION

Many young children take comfort in the use of a pacifier. Satisfying the child's natural tendency to suckle, the pacifier allows a parent to satisfy the child's instinct by providing a nipple upon which to suckle. As with any item exposed to a child it must be assured that it is kept clean and germ-free at all times. However, it is exceedingly difficult to determine whether or not pacifier is clean or dirty by simply looking at it. Many times, a pacifier found on a sink or countertop may have just been cleaned or may be there waiting to be cleaned. As such, many clean pacifiers are often re-cleaned and dirty pacifiers may be given back to child. Accordingly, there exists a need for means by which the current state of a pacifier's cleanliness can be easily determined. The development of the device described herein fulfills this need.

There have been attempts in the past to improve pacifiers. U.S. Pat. No. 6,905,507 issued to Hinshaw discloses a teething pacifier with varied teething surfaces thereon for a child to use for teething. Unfortunately, this patent does not appear to disclose a rotatably-mounted pacifier cleanliness indicator for visually displaying the hygienic status of a pacifier.

U.S. Pat. No. 6,695,869 issued to Fitzpatrick et al. discloses a pacifier with two substrates molded together. Unfortunately, this patent does not appear to disclose a pacifier with a cleanliness indicator.

U.S. Pat. No. D 532,522 issued to Struckmeyer discloses a pacifier with an open central area. Unfortunately, this design patent does not appear to be similar in appearance to the disclosed device, nor does it appear to possess a cleanliness indicator.

U.S. Pat. No. D 520,640 issued to Pilis discloses a pacifier. Unfortunately, this design patent does not appear to be similar in appearance to the disclosed device, nor does it appear to disclose a rotatably-mounted pacifier cleanliness indicator for visually displaying the hygienic status of a pacifier.

U.S. Pat. No. D 453,379 issued to Roehrig discloses a pacifier. Unfortunately, this patent does not appear to be similar in appearance to the disclosed device, nor does it appear to disclose a pacifier with a cleanliness indicator.

U.S. Pat. No. D 413,387 issued to Fitzpatrick discloses a pacifier with a ribbed nipple portion. Unfortunately, this design patent does not appear to be similar in appearance to the disclosed device.

U.S. Pat. No. D 393,074 issued to Fields et al. discloses a combined pacifier and clip attachment. Unfortunately, this design patent does not appear to be similar in appearance to the disclosed device, nor does it appear to disclose a rotatably-mounted pacifier cleanliness indicator for visually displaying the hygienic status of a pacifier.

U.S. Pat. No. D 380,836 issued to Simmons discloses a pacifier with a plurality of openings in the guard and handle. Unfortunately, this design patent does not appear to be similar in appearance to the disclosed device, nor does it appear to comprise a cleanliness indicator.

SUMMARY OF THE INVENTION

In light of the disadvantage as discussed previously in the prior art, it is apparent that there is a need for a pacifier cleanliness indicator that indicates the cleanliness state of an infant's pacifier.

An object of the pacifier cleanliness indicator comprises a pair of integral viewing ports to display indicia indicating whether the pacifier is clean and safe for usage.

A further object of the pacifier indicator system comprises a body, handle, and a guard fabricated of a Federal Food and Drug Administration (FDA) approved plastic.

An aspect of the pacifier cleanliness indicator comprises a body, a guard portion, a viewing port, a handle portion, a nipple portion attached to the guard portion, and a sliding member.

A further aspect of the pacifier cleanliness indicator comprises a body comprising a disc shape attached or molded to a rear surface of the guard. The body comprises a domed contour comprising a pair of receiving apertures to pivotally receive an end portion of the handle portion.

Still another aspect of the pacifier cleanliness indicator comprises a guard that is circumferentially-shaped to match a facial contour of a user such as a baby, infant, toddler, or child, and acts as a barrier between the face of the user and the handle portion.

Still a further aspect of the pacifier cleanliness indicator comprises a handle portion that is elliptically-shaped and provides a pivoting means about the inserting posts in relation to the body for easy grasping.

Yet another aspect of the pacifier cleanliness indicator comprises a body further comprising a window and an internal rotary sliding member. The sliding member comprises a flat circular disc rotatingly contained within said body being rotated in a parallel manner about a transverse axle. The sliding member pivots upon agitation of an operable tab that comprises a digit-operated appendage formed along a perimeter edge of the sliding member.

Yet a further aspect of the pacifier cleanliness indicator comprises a window portion of the body comprising a circular segment shaped opening therein a rear surface of the body that facilitates protrusion of the tab therethrough. The sliding member and the body are to remain in said selected position until repositioning of the tab occurs. The sliding member comprises a first notifying inscription and a second notifying inscription and two (2) viewing ports through which to observe said notifying inscriptions.

Yet still a further aspect of the pacifier cleanliness indicator comprises a transverse axle that provides rotary motion for the sliding member.

A method of utilizing the device may be achieved by performing the following steps: viewing the first notifying inscription through the window to verify the device is "CLEAN"; providing the device to a baby, toddler, infant, or child; once the child has completed use of the device, motioning the tab in a clockwise fashion thereby pivotally rotating the sliding member until it is stopped against an edge portion of the window, thus indicating that the device is "DIRTY";

viewing the "DIRTY" or second notifying inscription through the viewing port; and, cleansing the device for subsequent usage.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | pacifier cleanliness indicator |
| 20 | guard |
| 22 | nipple |
| 25 | aerating aperture |
| 30 | viewing port |
| 40 | body |
| 45 | receiving aperture |
| 46 | inserting post |
| 47 | window |
| 50 | handle |
| 60 | sliding member |
| 62 | axle |
| 65 | tab |
| 70 | first inscription |
| 72 | second inscription |

DETAILED DESCRIPTION OF THE PREFERRED EMBODIMENT

Figure 1:
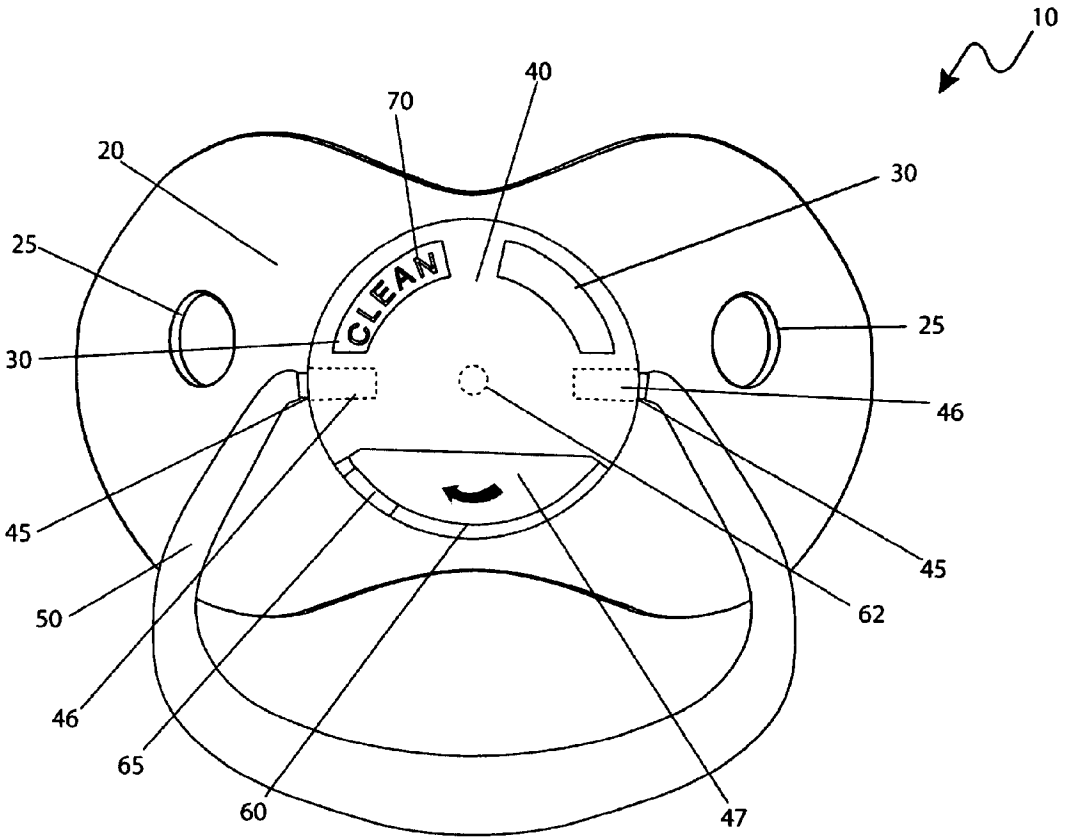
FIG. 1 is a rear view of a pacifier cleanliness indicator 10 specifying a first inscription 70, according to the preferred embodiment of the present invention.
Figure 2:
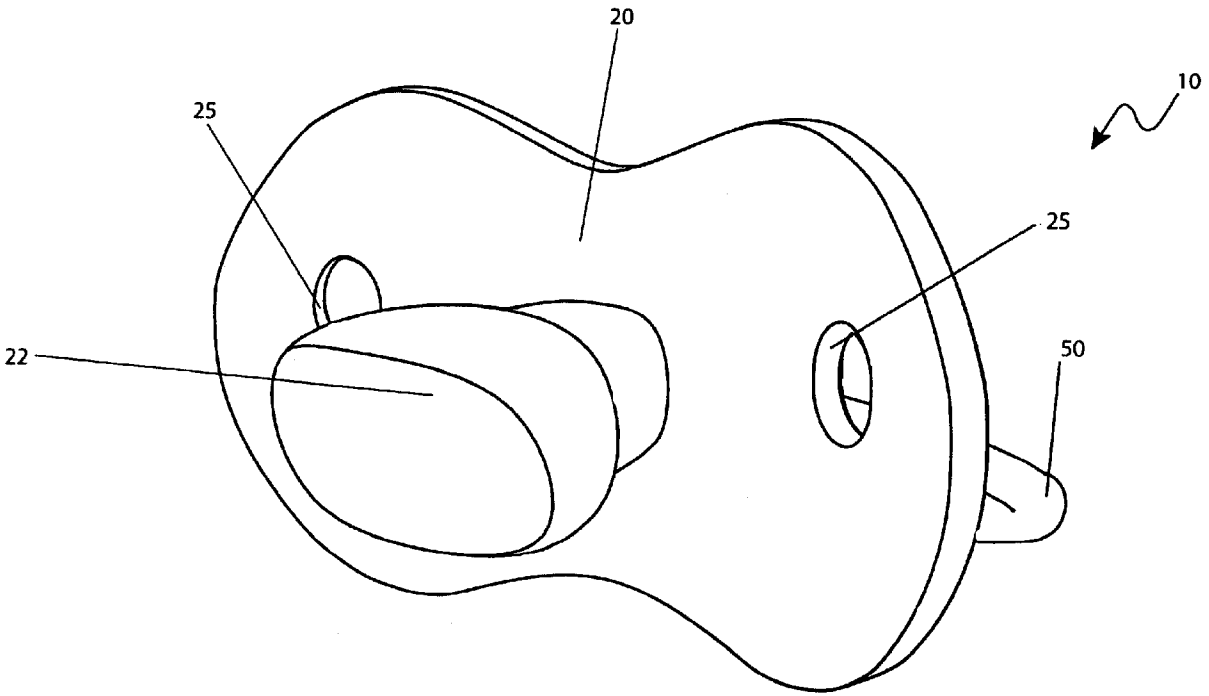
FIG. 2 is a front view of the pacifier cleanliness indicator 10, according to the preferred embodiment of the present invention; and, FIG. 3 is a rear cut-away view of the pacifier cleanliness indicator 10 depicting a second inscription 72, according to the preferred embodiment of the present invention.
Figure 3:
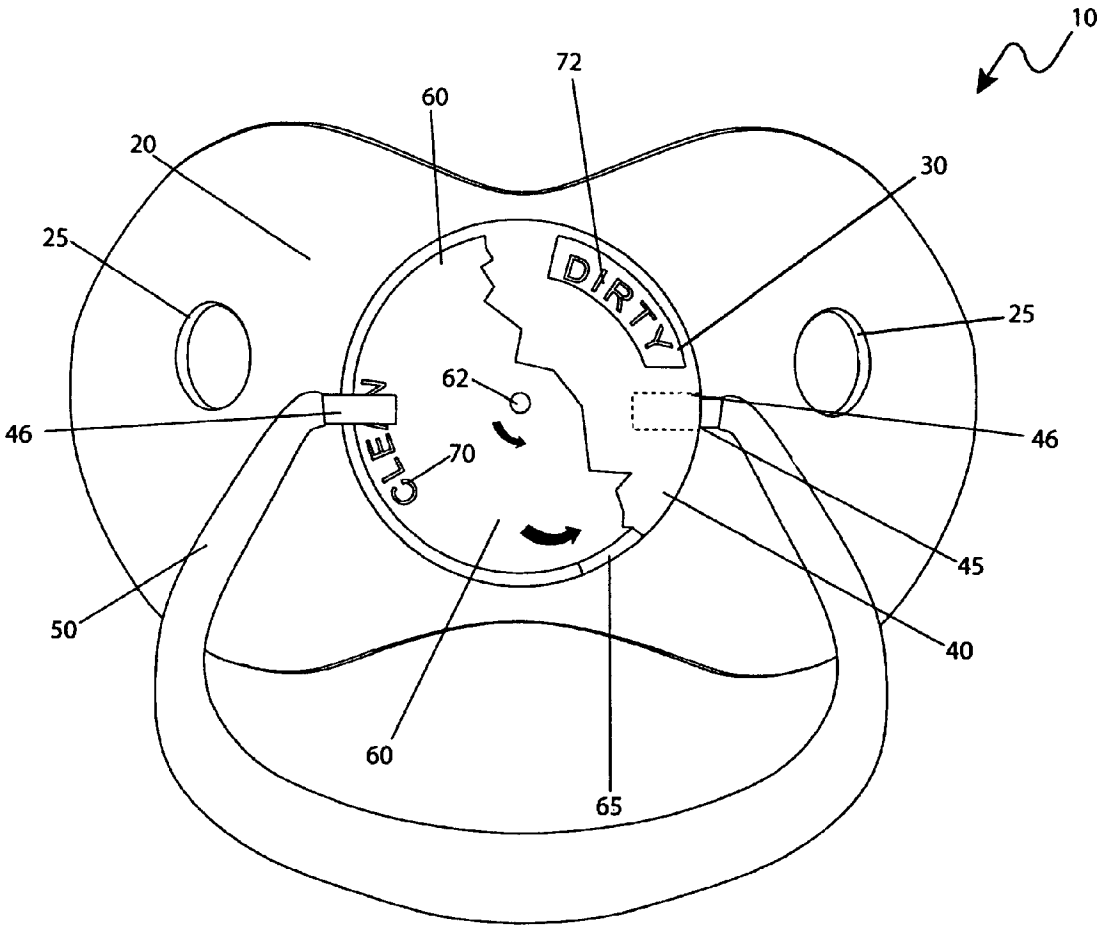

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a pacifier cleanliness indicator (herein described as the "device") 10, indicating a cleanliness state of an infant's pacifier via a display 30 for exhibiting said cleanliness state. The device 10 comprises a body 40, a guard 20, a viewing port 30, a handle 50, and a sliding member 60. The device 10 is envisioned to be introduced in a plurality of sizes and colors to accommodate children, toddlers, infants, and babies. The body 40, handle 50, and guard 20 are envisioned to be fabricated of a Federal Food and Drug Administration (FDA) approved plastic and produced using an injection molding process that would require the design and use of custom molds.

Referring now to FIGS. 1 and 2, a rear perspective and a side perspective view of the device 10, according to the preferred embodiment of the present invention, are disclosed. The device 10 provides a typical pacifier comprising additional enhancements comprising a guard 20, a nipple 22, a body 40, and a handle 50. Said guard 20, nipple 22, body 40, and handle 50 comprise a conventional design using FDA approved materials. The nipple portion 22 is envisioned to be of a hollow or solid design using materials such as, but not limited to: latex, silicone, natural rubber, or the like and attached thereto the guard portion 20 in a conventional manner using adhesives and/or compound molding techniques. The guard 20 is envisioned to be circumferentially shaped to match that of a facial contour of a user such as a baby, infant, toddler, or child, thereby acting as a barrier between the face of the user and the handle 50. The guard 20 may be a plurality of thicknesses, and comprises a plurality of aerating apertures 25 therethrough providing an aerating means thereof a facial area of a user especially while sucking on the nipple 22. The guard 20 may also be of a plurality of sizes with varying curvatures to allow a utilization of the device 10 on infants of various sizes and facial features.

The body 40 comprises a disc shape attached or molded thereto a rear surface of the guard 20 and positioned centered therewith and perpendicular thereto the nipple 22. The rearward surface of the body comprises a domed contour comprising a pair of receiving apertures 45 located at laterally opposed positions thereon to pivotally receive an end portion of a handle 50. The handle 50 is preferably elliptically shaped having a round cross-section; however, the device 10 may be introduced having various shaped handles 50 such as circumferential, rectangular, or any other suitable shape, with inserting posts 46 that are pivotally received thereinto the receiving aperture portions 45 of the body 40. The handle 50 provides a pivoting means thereabout said inserting posts 46 in relation to the body 40 for easy grasping. The body 40 is envisioned to comprise a window 47 and an internal rotary sliding member 60. The sliding member 60 comprises a flat circular disc rotatingly contained therewithin said body 40 being rotated in a parallel manner about a transverse axle 62 (see FIG. 3). The sliding member 60 is envisioned to pivot upon agitation of an operable tab 65 along a bottom perimeter portion of said sliding member 60. The tab 65 comprises a digit operated appendage formed along a perimeter edge of the sliding member 60 at a right angle and protruding therefrom a rear surface of the body 40. The window portion 47 of the body 40 comprises a circular segment shaped opening therein a rear surface of the body 40 along at a lower edge, thereby facilitating protrusion of said tab 65 therethrough. Upon receipt of pivotal agitation of said tab 65, the sliding member 60 rotatingly pivots about the transverse axle 62 in a clockwise or counterclockwise fashion thereby the user. Said window 47 further provides a rotary stopping means thereto the sliding member 60 when a certain desirable position is obtained. The stopping function of the window 47 would permit the sliding member 60 to pivot approximately one-quarter (¼) turn. Said selected position of the sliding member 60 is maintained via an internal friction means envisioned to result therefrom a snug fit therebetween said sliding member 60 and the body 40 and/or molded interfering features. Said sliding member 60 and the body 40 are to remain in said selected position until repositioning of the tab 65 occurs.

The sliding member 60 comprises a first inscription 70 and a second inscription 72 being printed, embossed, or otherwise marked thereon with notifying indication as to the cleanliness of the device 10. The inscriptions 70, 72 comprise preferably "CLEAN" and "DIRTY" indicia, respectively; however, it is understood that other indicating terms may be provided which also describe a contaminated or ready-to-use state of the device 10 with equal benefit. The tab 65 can be motioned, thereby rotating the sliding member 60 in a clockwise or counterclockwise fashion to display a desired notifying inscription 70, 72 into view as to notify the parent, care-giver, and/or other surrounding people that the device 10 is "CLEAN" or "DIRTY".

The body 40 further comprises two (2) viewing ports 30 located therealong an upper perimeter edge through which to observe said notifying inscriptions 70, 72. The notifying inscriptions 70, 72 are positioned thereupon the sliding member 60 so as to be displayed in an alternating manner such that a single notifying inscription 70, 72 is visible therethrough one (1) of two (2) viewing ports 30 based upon a relative position of the tab 65 while a second notifying inscription 70, 72 is concealed therebehind the rear surface of the body 40. The viewing ports 30 are envisioned to be sized accordingly in a manner which would allow the notifying inscriptions 70 to be viewed clearly.

Referring now to FIG. 3, a rear cut-away view of the device 10 depicting a "DIRTY" second inscription 72, according to the preferred embodiment of the present invention, is disclosed. The device 10 is illustrated here displaying the second notifying inscription 72 being displayed therein a viewing port 30 resulting therefrom rotary motioning of the tab 65 and sliding member 60 thereto an opposing edge of the window 47 (see FIG. 1). Additionally, a portion of the body 40 has been cut away to better illustrate a position of the first notifying inscription 70 in a hidden position therebeneath said body 40. The rotary motion of the sliding member 60 is provided via a transverse axle 62 integrally molded and protruding therefrom a rear surface of the guard 20 being inserted therethrough a center portion of said sliding member 60, thereby providing an axle-like function.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. The invention discloses an indicating means specifically for use on pacifiers which would indicate as to whether the device 10 was "CLEAN" and ready for use, or "DIRTY" and must be cleansed prior to additional use. After initial purchase or acquisition of the device 10, it would be configured as indicated in FIG. 1.

The method of utilizing the device 10 may be achieved by performing the following steps: viewing the first notifying inscription 70 therethrough the window 30 to verify the device 10 is "CLEAN"; providing the device 10 thereto a baby, toddler, infant, or child; once the child has completed use of the device 10, motioning the tab 65 in a clockwise fashion thereby pivotally rotating the sliding member 60 until it is stopped thereagainst an edge portion of the window 47, thus indicating that the device 10 is "DIRTY"; viewing the "DIRTY" or second inscription 72 therethrough the viewing port 30; and, cleansing the device 10 for subsequent usage.

The device 10 comprises a pair of integral viewing ports 30 to display whether said device 10 is clean and safe for usage. The tab 65 is envisioned to be utilized to rotate and position the sliding member 60 in a desired position so as to display the proper inscription 70, 72 as to whether the device 10 is "CLEAN" or "DIRTY", respectively. After cleansing the device 10 in a normal manner, the tab 65 may be motioned in a counterclockwise fashion until the "CLEAN" or first inscription 70 may be viewed clearly therethrough the viewing port 30. In such a manner, the parent, care-giver, or the like may be aware of a cleanliness state of the device 10, thereby safeguarding an infant from germs, soil, and the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pacifier comprising:

a body, comprising a distal end and a proximal end and further comprising:

a domed contour comprising a pair of receiving apertures located at laterally opposed positions thereon;

an internal rotary sliding member rotatingly affixed within said body being rotated in a parallel manner about a transverse axle;

a window comprising a circular segment-shaped opening in a rear surface of said body at a lower perimeter edge thereof through which to access and move said sliding member; and, a rotary stopping means for stopping said sliding member when a certain desired position is obtained;

a guard affixed to said body at a central location thereof;

a nipple affixed to said guard at a central location thereof; and, a handle pivotally attached to said pair of receiving apertures wherein said sliding member rotatingly pivots about said transverse axle in a clockwise or counterclockwise direction;

wherein said stopping means permits said sliding member to pivot approximately one-quarter turn; and, wherein said desired position of said sliding member is maintained via an internal friction means resulting from a fit between said sliding member and said body.

2. The pacifier of claim 1, wherein said body comprises a disc shape.

3. The pacifier of claim 2, wherein said body further comprises two viewing ports located along an upper perimeter edge thereof through which to observe said sliding member.

4. The pacifier of claim 3, wherein said sliding member further comprises:

a tab operably driving said sliding member comprising an appendage formed along a perimeter edge of said sliding member and protruding from a rear surface of said body through said window;

a first notifying inscription marked thereon a viewable surface thereof; and, a second notifying inscription marked thereon a viewable surface thereof adjacent thereto said first notifying inscription;

wherein said tab drives said sliding member in a rotary direction with respect to said transverse axle;

wherein said desired position corresponds to said first notifying inscription or said second notifying inscription being readily viewable through at least one of said two viewing ports;

wherein said first notifying inscription and said second notifying inscription are marked thereupon said sliding member in a position so as to be displayed in an alternating manner such that at least one notifying inscription is visible through at least one of said two viewing ports based upon a relative position of said tab while a second notifying inscription is concealed behind said rear surface of said body; and, wherein said stopping means comprises when said tab abuts either opposing inner wall of said window.

5. The pacifier of claim 4, wherein said first notifying inscription comprises "CLEAN".

6. The pacifier of claim 4, wherein said first notifying inscription comprises "DIRTY".

7. The pacifier of claim 1, wherein said guard comprises a circumferential shape generally corresponding to that of a face contour of a user;

wherein said guard provides a barrier between said face of said user and said handle.

8. The pacifier of claim 7, wherein said guard further comprises a plurality of aerating apertures therethrough providing an aerating means thereof said face of said user.

9. The pacifier of claim 1, wherein said nipple comprises a hollow fabrication.

10. The pacifier of claim 1, wherein said nipple comprises a solid fabrication.

11. The pacifier of claim 1, wherein said handle comprises an elliptically-shaped member with a round cross-section.

12. A method of determining a cleanliness state of a pacifier, comprising the following steps;

providing said pacifier further comprising;

a body, comprising a distal end and a proximal end, further comprising:

a domed contour comprising a pair of receiving apertures located at laterally opposed positions thereon to pivotally receive said handle;

a window comprising a circular segment-shaped opening in a rear surface of the body at a lower edge;

an internal rotary sliding member rotatingly affixed therewithin said body being rotated in a parallel manner about a transverse axle, further comprising a tab operably driving said sliding member comprising an appendage formed along a perimeter edge of said sliding member and protruding from a rear surface of said body through said window, a first notifying inscription comprising "CLEAN" marked on a first viewable surface of said sliding member, and a second notifying inscription comprising "DIRTY" marked on a second viewable surface of said sliding member adjacent to said first notifying inscription;

a rotary stopping means for stopping said sliding member when a certain desired position is obtained occurring when said tab abuts either opposing inner wall of said window;

said window comprising two viewing ports located along an upper perimeter edge of said body through which to observe said sliding member;

a guard affixed to said body at a central location thereof, further comprising:

a circumferential shape generally corresponding to that of a face contour of a user; and, a plurality of aerating apertures therethrough providing an aerating means thereof said face of said user;

a nipple affixed to said guard at a central location thereof; and, a handle pivotally attached to opposable outer side locations of said body, viewing said first notifying inscription through said at least one of said two viewing ports to verify said pacifier comprises a clean state;

providing said pacifier to said user;

allowing said user to complete use of said pacifier;

motioning said tab so as to pivotally rotate said sliding member until it is stopped against said window comprising said rotary stopping means, thus viewing said second notifying inscription through said window to indicate that said pacifier is in a dirty state;

viewing the "DIRTY" or second inscription through at least one of said two viewing ports;

cleaning said pacifier; and, motioning said tab so as to pivotally rotate said sliding member until it is stopped against said window comprising said rotary stopping means, thus viewing said first notifying inscription through said window to indicate that said pacifier is in said clean state for subsequent usage.

* * * * *